US006923333B2

(12) United States Patent
Arciniegas et al.

(10) Patent No.: US 6,923,333 B2
(45) Date of Patent: Aug. 2, 2005

(54) TAMPER RESISTANT PLASTIC INDUSTRIAL CONTAINER WITH PAIL, COVER AND POUR SPOUT CLOSURE

(76) Inventors: Alfonso N. Arciniegas, 7807 Beckwith Rd., Morton Grove, IL (US) 60053; Ron Sturk, #38 Lorne Ave., Brampton ON (CA), L6X-1L1

( * ) Notice: Subject to any disclaimer, the term of this patent is extended or adjusted under 35 U.S.C. 154(b) by 163 days.

(21) Appl. No.: 10/329,964

(22) Filed: Dec. 23, 2002

(65) Prior Publication Data

US 2004/0118880 A1 Jun. 24, 2004

(51) Int. Cl.[7] ..... B65D 51/18

(52) U.S. Cl. ..... 215/251; 215/253; 215/258; 215/274; 220/254.2; 220/257.1; 222/541.9

(58) Field of Search ..... 222/541.9, 529; 215/253, 251, 258, 274; 220/254.2, 257

(56) References Cited

U.S. PATENT DOCUMENTS 5,348,183 A * 9/1994 Luch et al. ..... 215/253
5,788,100 A * 8/1998 Sturk ..... 215/253
6,237,818 B1 * 5/2001 Kline ..... 222/541.9
6,386,405 B1 * 5/2002 Kars et al. ..... 222/541.9
6,450,357 B1 * 9/2002 Krautkramer et al. ... 220/254.2

* cited by examiner

*Primary Examiner*—Philippe Derakshani
(74) *Attorney, Agent, or Firm*—Alfonso N. Arciniegas

(57) ABSTRACT

The present invention is an improved plastic industrial container which may be used for packaging, shipping and dispersing a variety of liquids while protecting the contents from tampering and theft. The container is manufactured in components which include a pail body, a cover and a nestable pour spout closure. The improved container design facilitates press fit assembly of the cover to the pail in the usual manner, but which blocks tool insertion and undamaged removal of the cover. The invention specifically relates to an improved cover and closure combination which facilitates the press fit assembly of the closure to the cover but which resists tampering. The barrier molded with thin cross section with frangible elements to be easily damaged if tools are used in a prying manner on the closure wall resist tampering by restricting the clearance for tool insertion and closure removal.

11 Claims, 8 Drawing Sheets

TAMPER RESISTANT PLASTIC INDUSTRIAL CONTAINER WITH PAIL, COVER AND POUR SPOUT CLOSURE

An object of the present invention is to provide a tamper resistant container for packaging and dispensing liquids. The container is the commonly used open head plastic pail with separate cover and nestable pour spout closure. To be tamper resistant, industry practice is to make the cover difficult to remove from the pail and also make the closure difficult to remove from the cover. Additionally, covers and closures which are equipped with tamper evident features will discourage tampering.

Tampering with packaging for the undetected theft or replacement of the contents is a major problem. To discourage tampering with open head style plastic pails, the cover must be securely affixed to the pail body in a manner which discourages cover removal. The industry practice is to provide a cover with a tight fitting outer flange or skirt which conceals the annular latch between the pail and cover. The tight cover fit is often reinforced by adding a circumferential outer flange on the pail wall which further blocks access to the annular latch in a manner well understood in the industry. The cover to pail attachment is thereby considered tamper resistant. Only by cutting the cover skirt can the cover be removed.

Making a nestable pour spout closure installed in the cover tamper resistant has proven to be an ongoing area of interest and development.

There are several devices that attach the pouring spout to a lid, Kline U.S. Pat. No. 6,237,818 tamper evident pouring spout has a metal ring attaching the spout to the plastic lid.

Dwinell U.S. Pat. No. 5,256,225 secures a plastic spout by sonic welding it to the plastic lid. Ultrasonic welding of the closure to the cover is an effective tamper resistant bond, but the method suffers from high welding equipment cost and slow installation cycles.

Arciniegas U.S. Pat. No. 5,913,460 shows a plastic lid closure with a molded-on fused spout. Molding the cover around the closure so as to achieve a thermally bonded joint between cover and closure is also effective as a tamper resistant method. But this in-molding method also suffers from the high cost of interrupting the molding cycle to place a closure into the mold. The high installation costs make this closure type less competitive in the market.

Kars U.S. Pat. No. 6,386,405 shows a snap on closure and cylindrical outer collar, the collar in contact with the closure wall to squeeze the closure tighter to an outwardly facing cover beaded rim and aid in sealing. The outer collar also protects the leading edge of the outer wall from tampering. This closure can be pressed on for a low installation cost. This closure still has a large portion of the outer wall that is exposed above the locking collar, and is thus exposed to potential tampering.

Krautkramer U.S. Pat. No. 6,450,357 uses a press fit closure attachment with a U-shaped closure foot. The outer portion of the closure foot is pressed into a mating cover recess, the recess serving to block attempts at tampering and removal of the closure. The inner wall of the closure foot snaps over an inwardly facing beaded rim around the cover opening. This closure can also be pressed on for a low installation cost. This closure is tamper resistant but lacks tamper evidence. The cover wall just external of the closure foot is rigid for the potential use of levering tools. There is no thin projection to aid detection of tampering attempts. The closure also lacks a secondary locking ring or method to hold the inner closure foot engaged to the cover beaded rim. By extending the spout (without disturbing the cap bails) and pulling diagonally on the extended spout, the closure is vulnerable to release from the cover beaded rim.

Sturk U.S. Pat. No. 5,788,100 discloses an all-plastic snap-on closure with a locking ring initially attached by frangible webs to the periphery of the closure cap. During installation the locking ring is broken off the cap and is pressed in locking engagement around the closure body outer wall. While the closure attachment to the cover is very secure, the outer lock ring and closure are exposed to undetected tampering. It is an objective of the preferred embodiment of this invention to add tamper resistant means to the cover to protect the closure from tampering.

Note on Tamper Evident Features

While the pouring spout have been regularly improved to incorporated new features, mounting the closure within the container lid has posed problems related to difficulty of installation as well as quality control and product integrity. In one well know method, the spout is positioned over the lid opening in the container cover and a metal ring around the flange of the spout is crimped over the peripheral flange of the spout to hold the spout over the cover. For example, in the oil lubricants industry, refined oil is filled through an opening in the plastic lid into a 5 gallon plastic pail. Next, a pouring spout assembly with cap is attached to the cover opening by a crimping metal ring. However the spout could easily be pried off and re-crimped without detection.

With the present invention the same procedure could be followed, however instead of a metal crimp spout that is used today, an all plastic pouring spout assembly could be attached to the cover by simply press fitting the spout assembly into the tamper resistant cover opening.

A better application is known for securing the spout to the opening bead with an external lock ring, Sturk U.S. Pat. No. 5,788,100 closure with two position lock ring allows the spout to be secure to the opening bead. During installation the closure body is first pressed into engagement over the cover opening beaded rim. Secondly, the annular lock ring is broken off the cap and is press fitted over the body skirt, securely locking the closure in attachment to the cover. The result is a secure seal, but the locking ring is exposed to tampering and could be removed allowing the closure assembly to come off the cover and be reinstalled without detection. A similar limitation exists with McLelland U.S. Pat. No. 5,797,525 where the outer plastic ring could easily be pried upward from the cover without damaging the closure.

It is an objective of this invention to improve the design of the cover opening to protect press fit closures from tampering. Press fit closures which have a low cost installation advantage over welding and in-molding closures, would achieve greater market acceptance. In the preferred arrangement an all plastic press fit closure made up a flexible pouring spout surrounded by an annular sealing channel is fitted with an overlying screw cap. An annular lock ring is integrally connected about the periphery of the screw cap so as to extend radially outwardly of the closure body sealing channel. During installation the closure is pressed onto a circumferentially enlarged upstanding opening neck causing the sealing channel to snap there over. Secondly, during closure installation the locking ring is broken away from the cap periphery and is axially pressed around the outer wall of the body sealing channel so as to lock the same against the opening neck. The result is a very strong closure cover wall connection.

With this invention, the plastic cover is molded with an opening adapted for secure attachment of a plastic press fit closure and a channel with a outer wall and thin barrier wall around the opening that closely encloses the outer diameter of the installed closure assembly. A tall narrow gap between the outside of the installed closure and the protective annular barrier wall restricts access for tools to tamper with or pry off the closure. The top thin barrier wall may be further adapted with frangible sections that readily show damage from attempted tampering. This feature makes the dispensing closure anti-theft and tamper evident.

LIST OF DRAWING NUMBERS

| Number | Description |
|---|---|
| 1 | container |
| 2 | container body |
| 3 | container cover |
| 4 | dispensing closure |
| 5 | cover flat panel |
| 6 | cover outer skirt |
| 7 | container body projection |
| 8 | closure cap |
| 9 | |
| 10 | cross section view |
| 11 | cap bail |
| 12 | lock ring |
| 13 | closure body |
| 14 | closure body inner wall |
| 15 | closure body outer wall |
| 16 | body outer wall notch |
| 17 | |
| 18 | |
| 19 | |
| 20 | container opening |
| 21 | opening annular neck |
| 22 | opening beaded rim |
| 23 | bottom sump wall |
| 24 | outer sump wall |
| 25 | annular outer wall |
| 26 | thin barrier wall |
| 27 | frangible section |
| 28 | gap |
| 29 | no beaded rim |
| 30 | inward facing beaded rim |
| 31 | flat opening |
| 32 | |

DESCRIPTION OF THE DRAWINGS

The present invention will be more fully understood by reference to the following detailed drawings and description of a preferred embodiments of the present invention

DETAILED DESCRIPTION OF THE INVENTION

Figure 1:
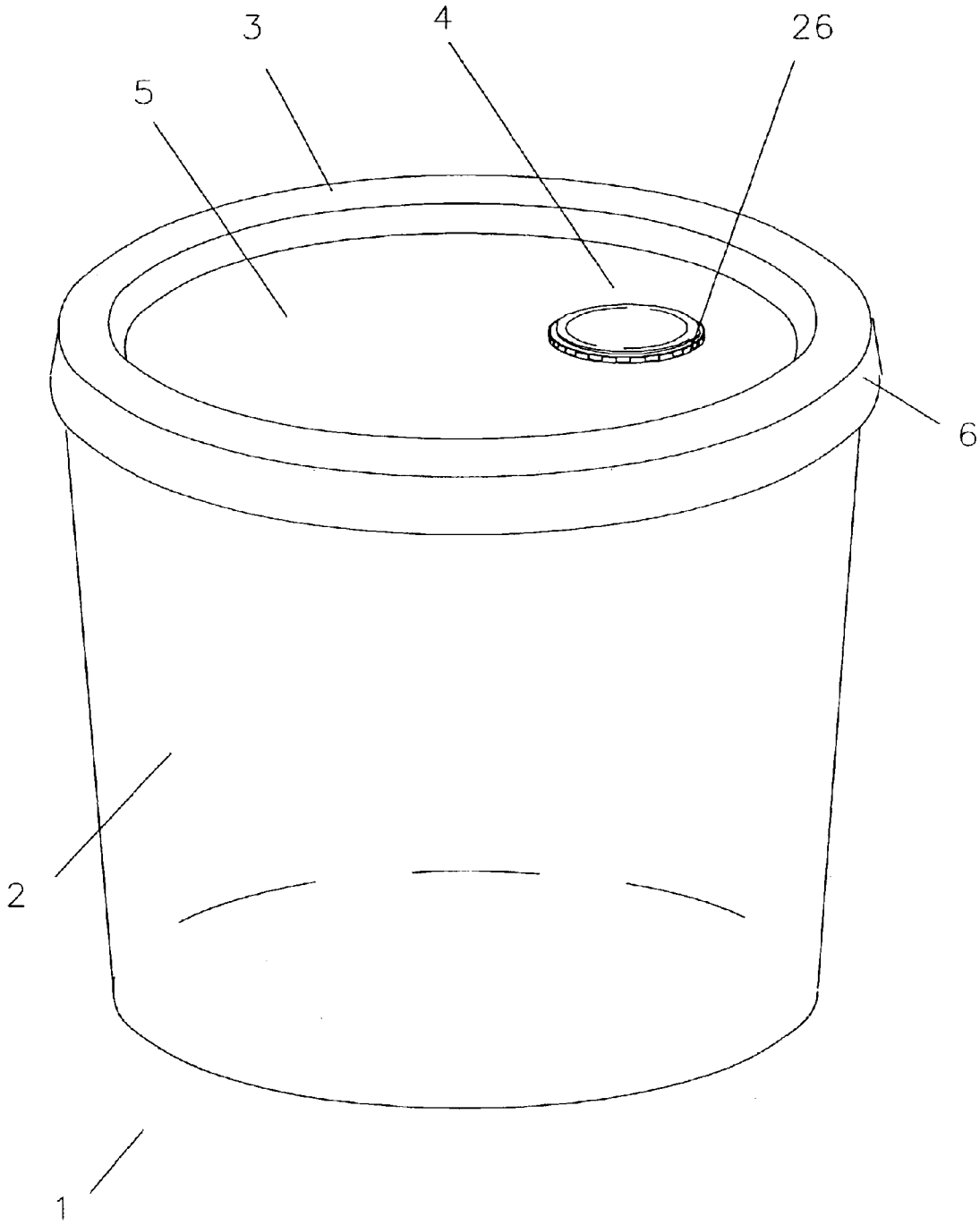
FIG. 1 is a perspective view of a container comprised of a container body, a container cover having an opening and a dispensing closure attached to the cover.
Figure 2:
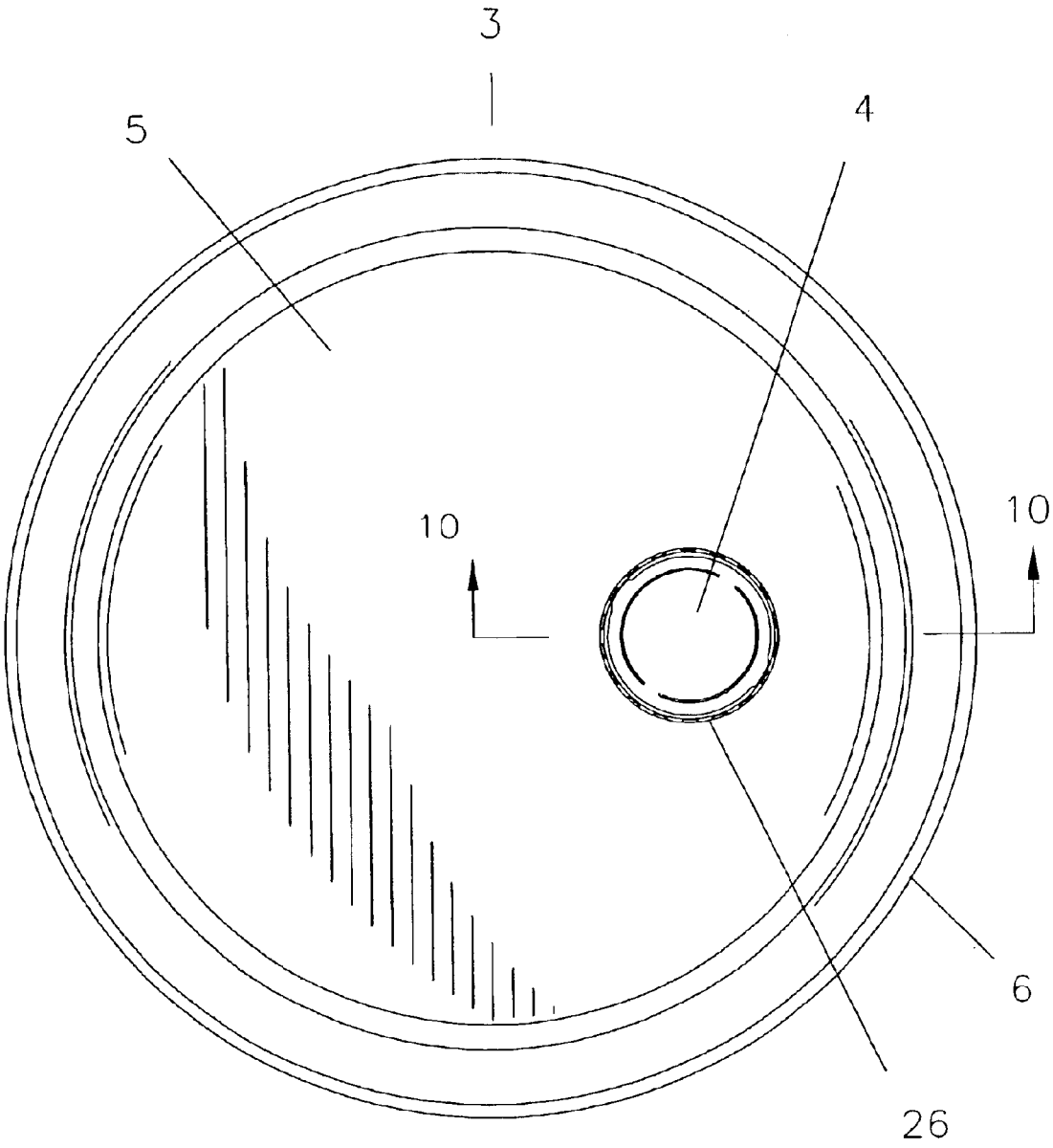
FIG. 2 is a top view of a cover having an opening and a dispensing closure attached to the cover.

FIG. 1 and FIG. 2 shows a container 1 assembled from a container body 2, a disc shaped container cover 3 having a peripheral cover outer skirt 6 for engagement with the side wall of the container body 2 to maintain the material within the container 1. In a known manner, the container cover 3 having a flat panel 5, and a dispensing closure 4 secured to the cover 3. The dispensing closure 4 is used to protect the contents during shipment and to remove contents from the container. Typically, the container body 2 and container cover 3 are molded of plastic material. To remove contents from the container 1, the cover 3 is molded with an opening 26 adapted to receive the dispensing closure 4. The container 1 is made tamper resistant by restricting external access to undo the latching engagement of the cover 3 to the container body 2, and by restricting external access to undo the latching engagement of the closure 4 to the container cover 3.

Figure 3:
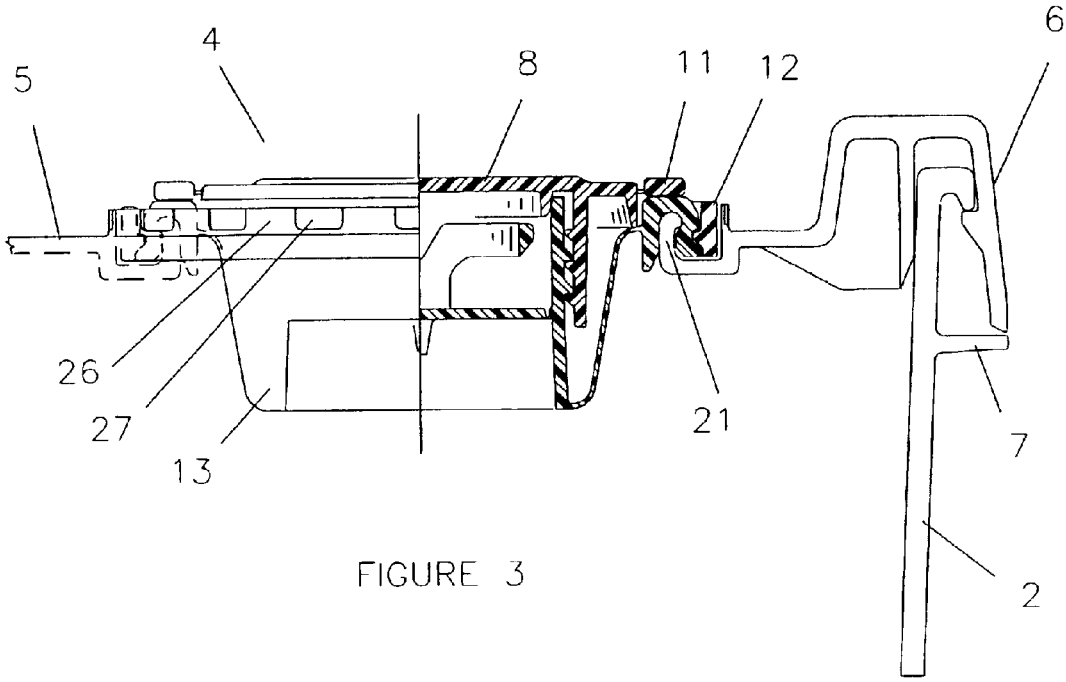
FIG. 3 is a profile and cross sectional view of the container cover attached to the container body, and the dispensing closure installed in the cover opening, and the closure surrounded by a thin barrier wall.

As seen in FIG. 3, the container cover 3 is assembled to container 2 in the usual manner. After assembly the cover outer skirt 6 is in close proximity to container body projection 7. The close proximity of the outer skirt 6 and body projection 7 restricts external access of tools under the cover outer skirt 6 to unlatch the cover. Attempted cover removal will leave visible damage marks on the plastic outer skirt 6 or body projection 7, making it tamper evident. FIG. 3 also shows a pull up style dispensing closure 4 installed on cover opening annular neck 21. Installation of closure 4 is by press fit latching engagement in a manner described in greater detail in FIG. 9 below. The installed closure 4 is closely surrounded by a thin barrier wall 26. The thin barrier wall may be further adapted with frangible sections 27. The close proximity of the thin barrier wall 26 to the installed closure 4 prevents the easy access of tools under the closure lock ring 12 to remove the closure 4. Attempted closure removal will leave visible damage marks on the thin barrier wall 26 and frangible sections 27, making it tamper evident.

Figure 4:
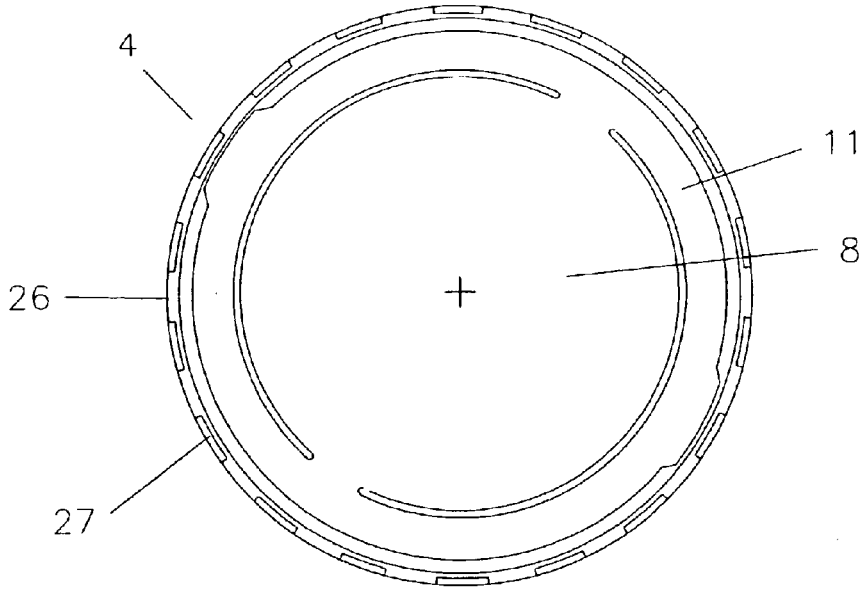
FIG. 4 is a top view of the dispensing closure installed in the container cover and surrounded by a thin barrier wall.

FIG. 4 is a top view of the dispensing closure 4 surrounded by thin barrier wall 26. The closure cap 8 is equipped with cap bails 11. Installed dispensing closure 4 is closely surrounded by thin barrier wall 26.

Figure 5:
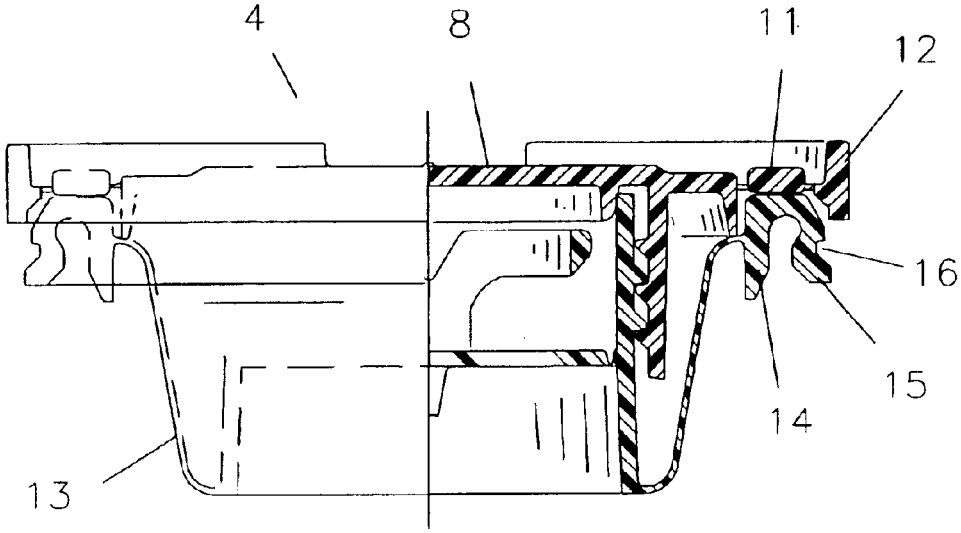
FIG. 5 is a profile and cross sectional view of a dispensing closure with outer two position lock ring prior to installation.

Referring to FIG. 5, the closure 4 is comprised of a plastic threaded cap 8 leading outward to cap bails 11 and an annular lock ring 12. The cap is mounted by threads to closure body 13. Closure body 13 is molded from flexible plastic, and may be subsequently extended to the dispensing position by lifting on the cap bails in a manner well understood. The closure body 13 leads to an annular inner wall 14 and outer wall 15 adapted for attachment to the container cover 3. The body outer wall 15 is equipped with an annular outer notch 16 for subsequent engagement with lock ring 12.

Figure 6:
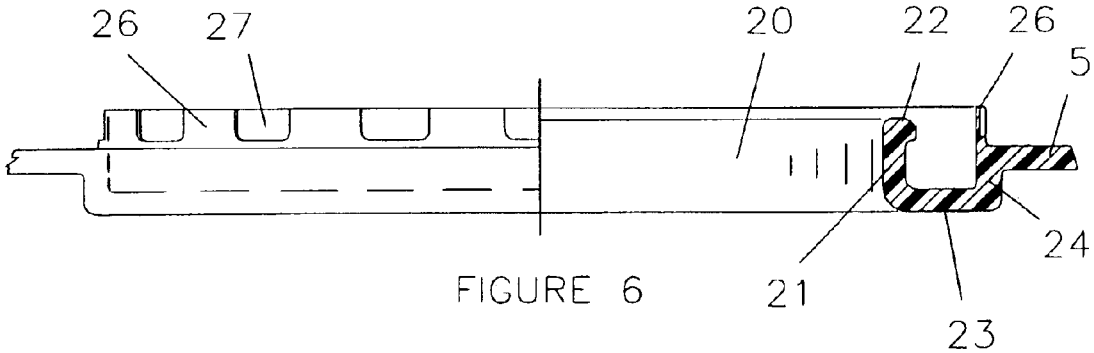
FIG. 6 is a profile and cross sectional view of a cover opening with bottom sump wall and thin barrier wall.
Figure 7:
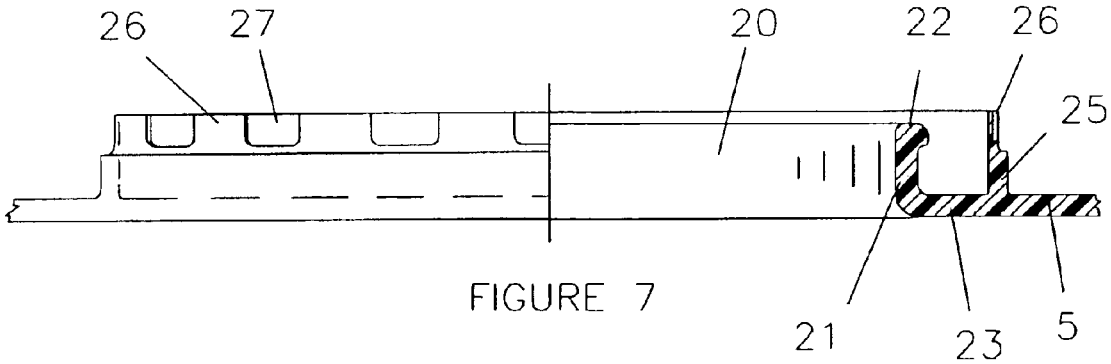
FIG. 7 is a profile and cross sectional view of a cover opening with outer wall and thin barrier wall.

Referring to FIGS. 6 and 7, the cover 5 incorporates a cover opening 20, the cover opening 20 being defined by an opening annular neck 21. The neck 21 leading vertically to an outward beaded rim. The neck 21 is also leading radial outward to a bottom wall 23. In FIG. 6 the bottom wall 23 leads vertically to annular outer sump wall 24. The vertical wall 24 leading outward to cover flat panel 5 and leading vertically upward to annular thin barrier wall 26. The neck 21, bottom wall 23, vertical wall 24 and barrier wall 26 define a "U" shaped sump to receive dispensing closure 4. In FIG. 7 the bottom wall 23 leads outward to cover flat panel 5 and vertically to annular outer wall 25 and thin barrier wall 26. The neck 21, bottom wall 23 and outer wall 25 and barrier wall 26 define a "U" shaped recess to receive dispensing closure 4.

Figure 8:
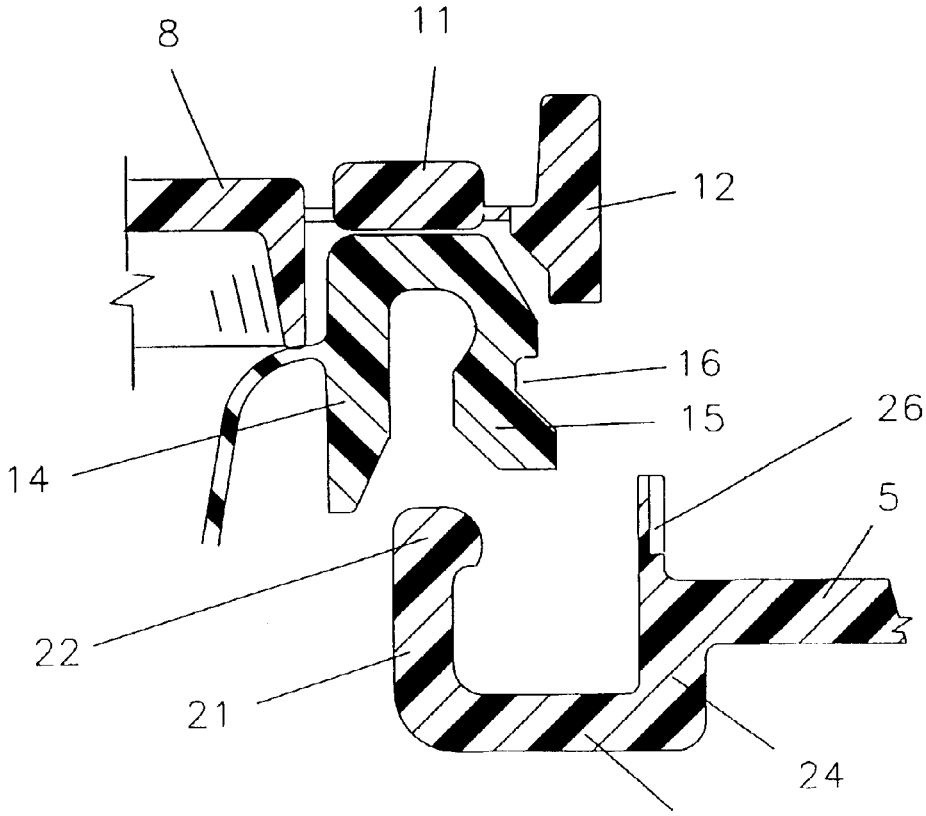
FIG. 8 is an enlarged partial cross sectional view of a dispensing closure with two position lock ring, and a container opening with "U" shaped sump and barrier wall prior to closure installation.

FIG. 8 shows the partial detailed view of a plastic threaded cap 8 leading outward to cap bails 11 and an annular lock ring 12. The closure body 13 leads to an annular inner wall 14 and outer wall 15 adapted for attachment to the container cover 3. The neck 21, bottom wall 23, vertical wall 24 and barrier wall 26 define a "U" shaped sump to receive dispensing closure 4. Cover flat panel 5 leads outward from vertical wall 24 and thin barrier wall 26. Vertical wall 24 and thin barrier wall 26 must be larger in diameter than lock ring 12 to allow for press fit installation of the closure 4. By keeping the bottom wall 23 below the elevation of the cover flat panel 5, dispensing closure 4 may be partially recessed in the cover 3. A partially recessed dispensing closure 4 increases clearance between containers 1 that are vertically stacked.

Figure 9:
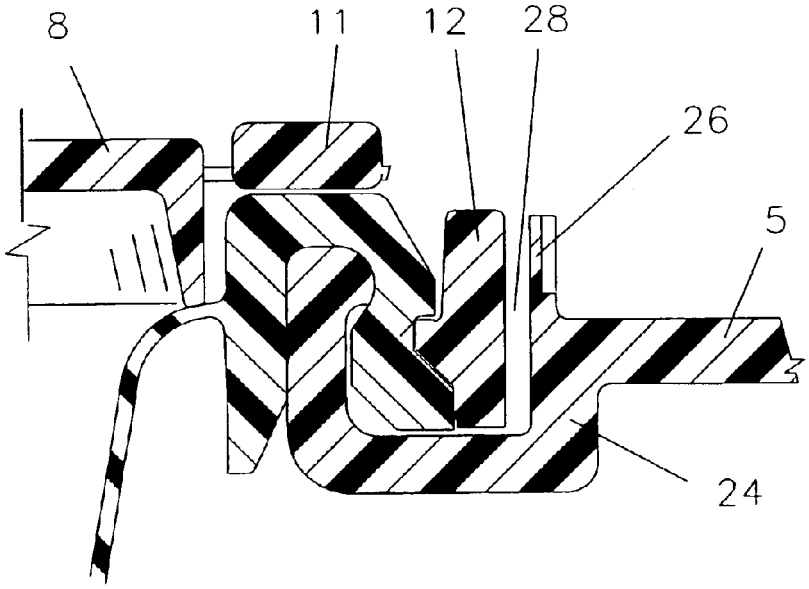
FIG. 9 shows FIG. 8 after installation of the closure onto the cover. The closure body is snapped onto the cover beaded rim, and the lock ring is in locked position. The outer wall and barrier wall, forming a close barrier around the periphery of the closure lock ring, said barrier optionally containing frangible sections.

FIG. 8 also shows the closure body inner wall 14 and outer wall 15 positioned vertically and in alignment over the cover beaded rim 22 to initiate installation. The two position cap lock ring 12 is shown in the first open or unlocked position in FIG. 8. The lock ring is attached to the cap bails 11 with frangible webs. By first applying pressure to the cap bails 11, the closure body inner wall 14 and outer wall 15 are forced to slide in engagement over opening annular neck 21. The closure body outer wall 15 expands radially outward over beaded rim 22, and then inward to a more relaxed position. Pressure is next applied to the annular cap lock ring 12 to break the frangible webs and press the lock ring 11 into locking embrace over the closure body outer wall 15 as shown in FIG. 9. An inner projection on lock ring 11 engages body outer wall notch 16 to retain lock ring 11 in the locked position.

In the closure installed position in FIG. 9, the closure 4 is firmly engaged and locked to annular neck 21 and beaded rim 22. Lock ring 12 captures body outer wall 15 from possible expansion and retraction off beaded rim 22. As is also dearly shown in FIG. 9, the lock ring is closely surrounded by outer sump wall 24 and thin barrier wall 26.

The thin barrier wall 26 which is molded from plastic may be further adapted with thinner frangible sections 27. The close proximity of the thin barrier wall 26 prevents the easy access of tools under the closure lock ring 12 to remove the closure 4. Attempted closure removal will leave visible damage marks on the thin barrier wall 26, and the frangible sections 27 may stretch and break leaving further tamper evidence.

Figure 10:
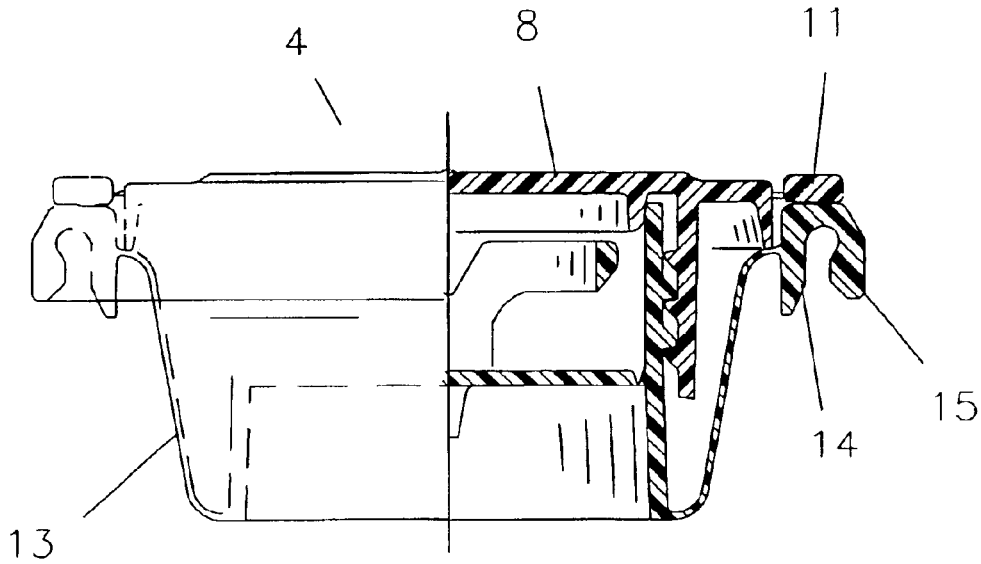
FIG. 10 is a profile and cross sectional view of a dispensing closure prior to installation, the closure not having an outer two position lock ring.

Referring to FIG. 10, the closure 4 is comprised of a plastic threaded cap 8 leading outward to cap bails 11. The cap is mounted by threads to closure body 13. Closure body 13 is molded from flexible plastic, and may be subsequently extended to the dispensing position by lifting on the cap bails in a manner well understood. The closure body 13 leads to an annular inner wall 14 and outer wall 15 adapted for attachment to the container cover 3.

Figure 11:
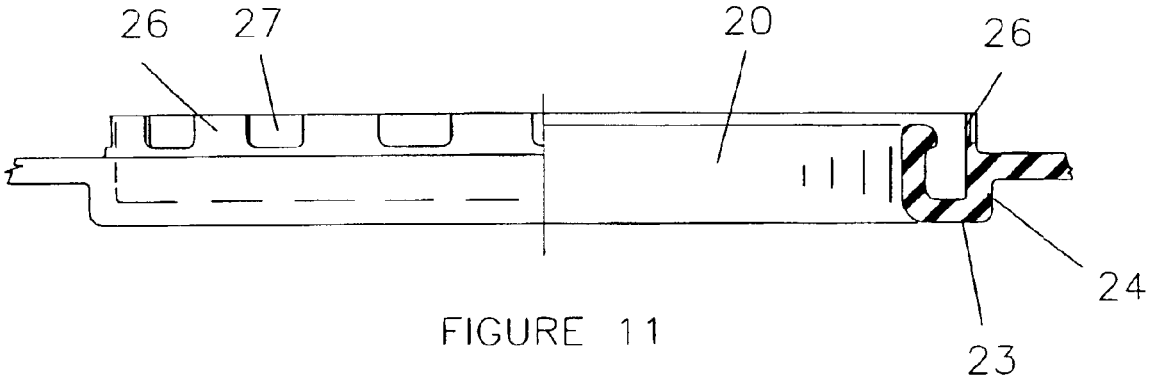
FIG. 11 is a profile and cross sectional view of a cover opening with bottom sump wall and thin barrier wall.
Figure 12:
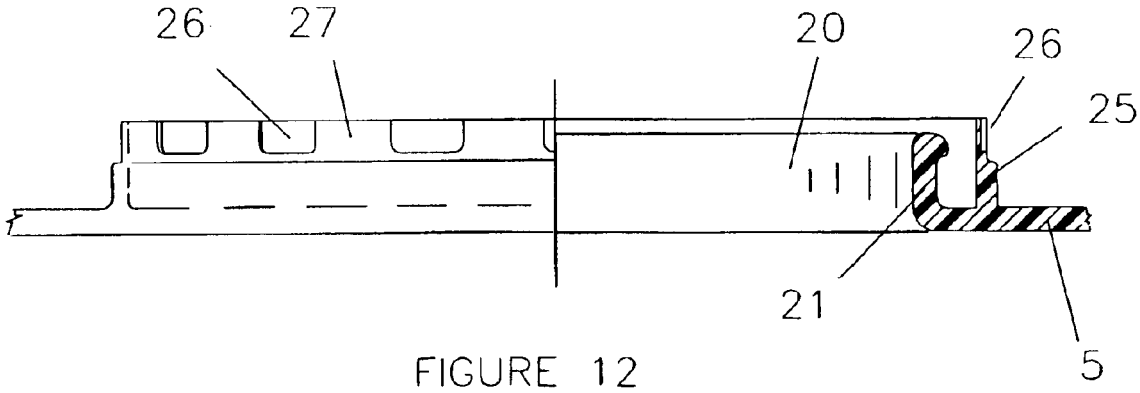
FIG. 12 is a profile and cross sectional view of a cover opening with outer wall and thin barrier wall.

Referring to FIGS. 11 and 12, the cover 3 incorporates a cover opening 20, the cover opening 20 being defined by an opening annular neck 21. The neck 21 leading vertically to an outward beaded rim. The neck 21 also leading radially outward to a bottom wall 23. In FIG. 1 the bottom wall 23 leads vertically to annular outer sump wall 24. The vertical wall 24 leading outward to cover flat panel 5 and leading vertically upward to annular thin barrier wall 26. The neck 21, bottom wall 23, vertical wall 24 and barrier wall 26 define a "U" shaped sump to receive dispensing closure 4. In FIG. 12 the bottom wall 23 leads outward to cover flat panel 5 and vertically to annular outer wall 25 and thin barrier wall 26. The neck 21, bottom wall 23 and outer wall 25 and barrier wall 26 define a "U" shaped recess to receive dispensing closure 4.

Figure 13:
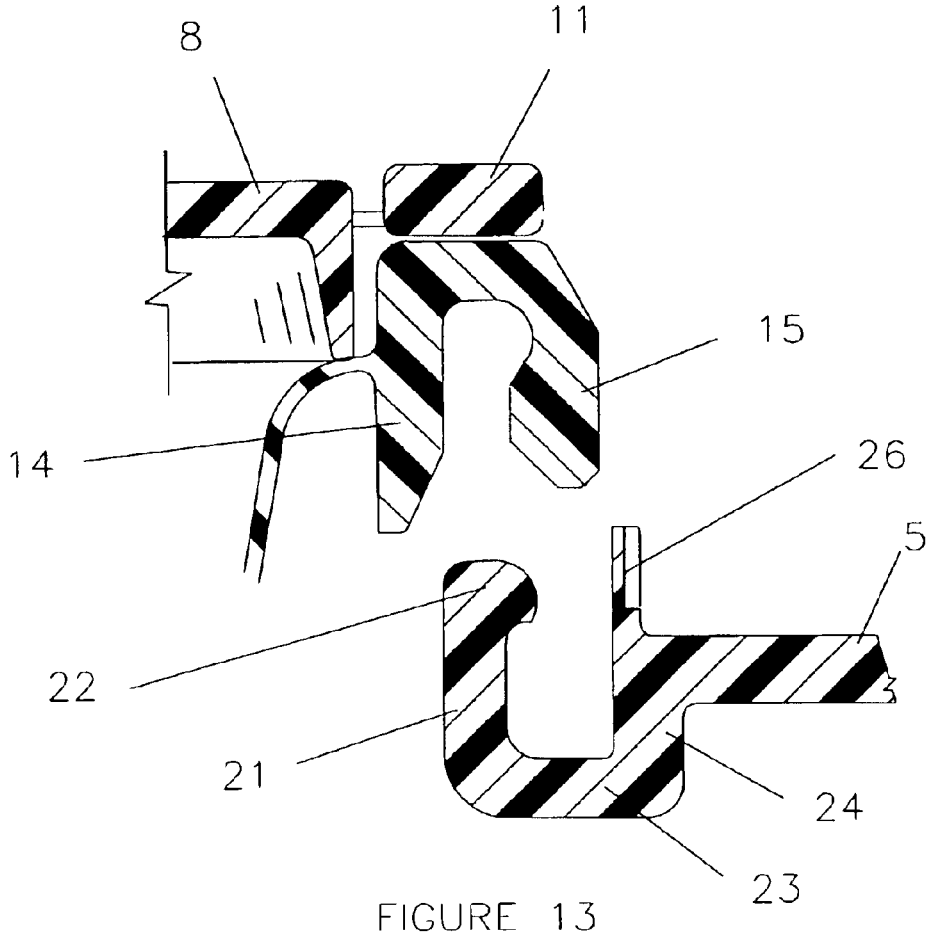
FIG. 13 is an enlarged partial cross sectional view of a dispensing closure and a container opening prior to closure installation, the closure not having a two position lock ring.

FIG. 13 shows the partial detailed view of a plastic threaded cap 8 leading outward to cap bails 11. The closure body 13 leads to an annular inner wall 14 and outer wall 15 adapted for attachment to the container cover 3. The neck 21, bottom wall 23, vertical wall 24 and barrier wall 26 define a "U" shaped sump to receive dispensing closure 4. Cover flat panel 5 leads outward from vertical wall 24 and thin barrier wall 26. Vertical wall 24 and thin barrier wall 26 must be larger in diameter than body outer wall 15 to allow for press fit installation of the closure 4. By keeping the bottom wall 23 below the elevation of the cover flat panel 5, dispensing closure 4 may be partially recessed in the cover 3. A partially recessed dispensing closure 4 increases clearance between containers 1 that are vertically stacked.

FIG. 13 also shows the closure body inner wall 14 and outer wall 15 positioned vertically and in alignment over the cover beaded rim 22 to initiate installation. The two position cap lock ring 12 is shown in the first open or unlocked position in FIG. 8. By first applying pressure to the cap bails 11, the closure body inner wall 14 and outer wall 15 are forced to slide in engagement over opening annular neck 21. The closure body outer wall 15 expands radially outward over beaded rim 22, and then inward to a more relaxed position.

Figure 14:
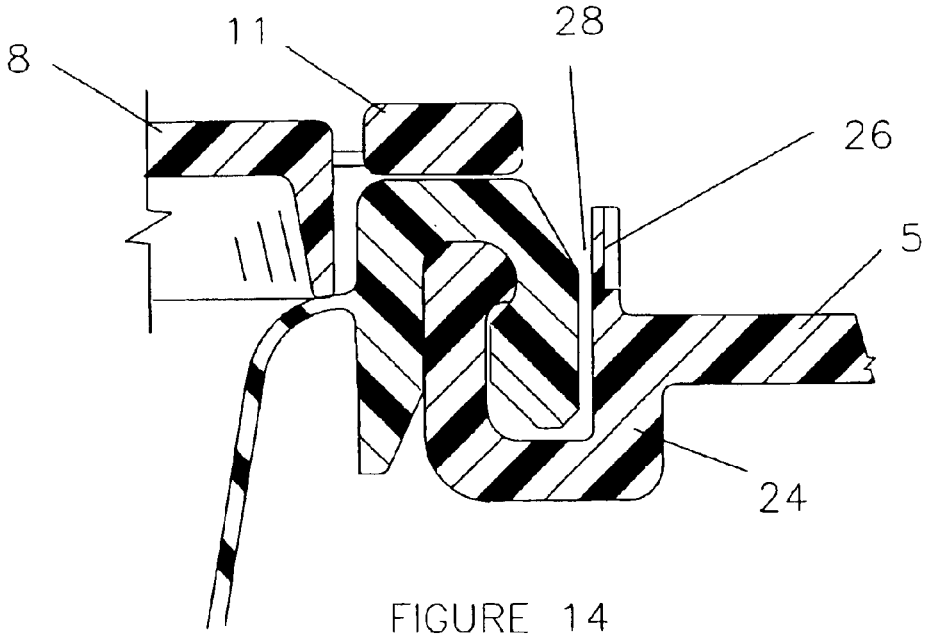
FIG. 14 shows FIG. 13 after installation of the closure onto the cover. The closure body is snapped over the cover beaded rim. The outer wall and thin barrier wall form a close barrier around the periphery of the closure lock ring, said barrier wall optionally containing frangible sections.

In the closure installed position in FIG. 14, the closure 4 is firmly engaged with annular neck 21 and beaded rim 22.

The interference fit of body outer wall 15 over the beaded rim 22 holds the closure in position. The body outer wall-1 is closely surrounded by outer sump wall 24 and thin barrier wall 26. There is typically a small gap 28 between outer wall 15 and barrier wall 26.

The thin barrier wall may be further adapted with frangible sections 27. The close proximity of the thin barrier wall 26 prevents the easy access of tools under closure outer wall 15 to pry off the closure 4. Attempted closure removal will leave visible damage marks on the thin barrier wall 26 and frangible sections 27, making it tamper evident.

Figure 15:
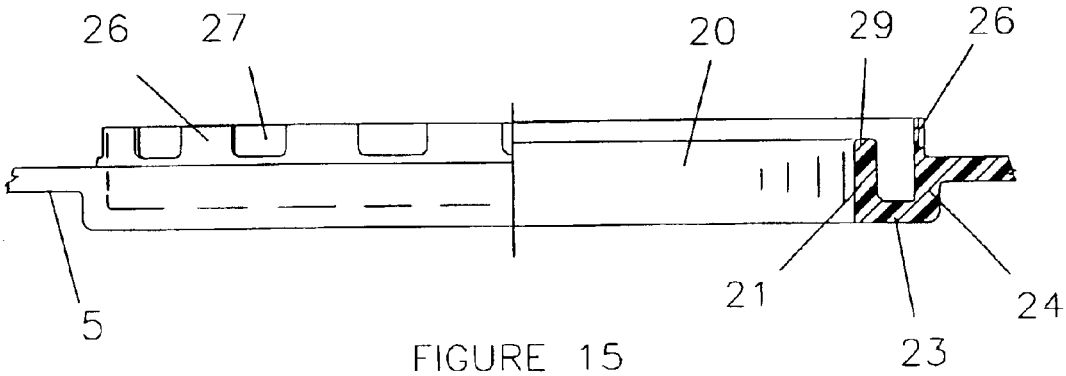
FIG. 15 is a profile and cross sectional view of an alternate cover opening with opening annular neck, the neck having no beaded rim, the opening surrounded by a thin barrier wall.

FIG. 15 shows an alternate cover openings 20 where the opening annular neck 21 (leads vertically to no beaded rim 29. This style of opening could be readily used for air vent which are designed to allow air into containers for venting purposes. The cover opening 20 is surrounded by the thin barrier 26 in the usual manner.

Figure 16:
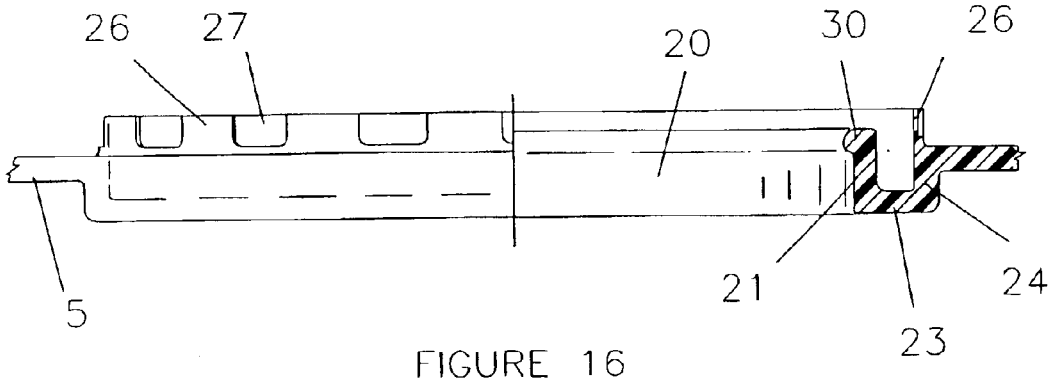
FIG. 16 is a profile and cross sectional view of an alternate cover opening with opening annular neck, the neck having an inward facing beaded rim, the opening surrounded by a thin barrier wall.

FIG. 16 shows an alternate cover openings 20 where the opening annular neck 21 leads vertically to a radially inward facing beaded 30. The cover opening 20 is surrounded by thin barrier 26 in the usual manner.

Figure 17:
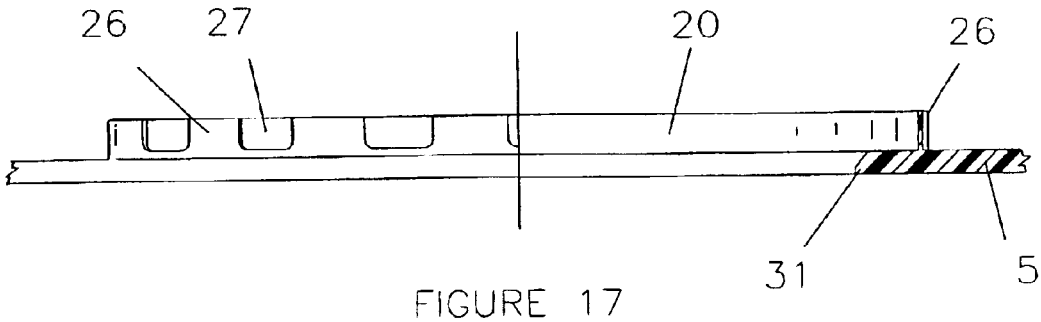
FIG. 17 is a profile and cross sectional view of an alternate cover opening with no annular neck, the opening surrounded by a thin barrier wall.

FIG. 17 shows an alternate cover openings 20 where the opening leads outward to the cover flat panel 5. This style of opening could also be readily used for air vent closures which are designed to allow air into containers for venting purposes. The cover opening 20 is surrounded by thin barrier 26 in the usual manner.

Various embodiments of the invention have now been described in detail. Since changes in and/or additions to the above described best mode may be made without departing from the nature spirit or scope of the invention, the invention is not to be limited to said details.

We claim:

1. In combination, a plastic cover having an opening molded therein for dispensing liquids from a container, said cover opening surrounded by an upstanding annular neck terminating in a beaded rim, a dispensing closure mounted on said container annular neck and said beaded rim, the base of said annular neck leading outward to a flat bottom sump wall, said bottom sump wall leading to an upstanding annular outer wall which closely surrounds said dispensing closure, said outer wall leading outward to the flat panel of the container cover, said outer wall leading upward to a top annular barrier wall which closely surrounds said dispensing closure, said barrier wall being tall and thin in cross section to readily show damage from attempted tampering.

2. A combination as in claim 1, said barrier wall incorporating one or more thin frangible sections.

3. A combination as in claim 1, said dispensing closure having a body inner wall, and body outer wall which form an annular recess for a sealing engagement with said container beaded rim, said body outer wall closely surrounded by said top annular barrier wall, said barrier wall adapted to show damage from attempted tampering.

4. A combination as in claim 1, said cover opening surrounded by an upstanding annular neck termination in a beaded rim, said beaded rim projecting radially inward resulting in a smaller diameter than annular neck.

5. A combination as in claim 1, said dispensing closure having an inner body wall, top body wall and body outer wall which form an annular recess for sealing engagement with container beaded rim, said dispensing closure further having a cap with a two position outer frangible lock ring, during installation of said closure, said frangible lock ring being pressed into locking position around said body outer wall, said lock ring in locked position closely surrounded by said top annular barrier wall, said barrier wall to adapted to show damage from attempted tampering.

6. A combination as in claim 4 wherein the top of said lock ring in locked position is substantially level with the top of said barrier wall.

7. A combination as in claim 1, said plastic cover flat panel leading to an outer perimeter annular skirt, said annular skirt leading downward to inner locking channel, said inner channel adapted for press fit installation over said container to effect closure thereof.

8. In combination a container having a top open end, a plastic cover installed on said container, said plastic cover having an opening molded therein for dispensing liquids from a container, said cover opening surrounded by an upstanding annular neck terminating in an outwardly facing beaded rim, a dispensing closure mounted on said container beaded rim, the base of said annular neck leading outwardly to a flat bottom sump wall, said bottom sump wall leading to an upstanding annular outer wall which closely surrounds said dispensing closure, said outer wall leading outward to the flat panel of the container cover, said outer wall and flat panel leading upward to a top annular barrier wall which closely surrounds said dispensing closure, said barrier wall being tall and thin in cross section and adapted with one or more thin frangible sections to show damage from attempted tampering.

9. In combination, a plastic cover having an opening molded therein for dispensing liquids from a container, said cover opening surrounded by an upstanding annular neck terminating in a beaded rim, a dispensing closure mounted on said container annular neck and said beaded rim, the base of said annular neck leading outward to a flat bottom sump wall, said bottom sump wall leading to an upstanding annular outer wall which closely surrounds said dispensing closure, said outer wall leading outward to the flat panel of the container cover, said outer wall and flat panel leading upward to a top annular barrier wall which closely surrounds said dispensing closure, the opening having a depressed channel raised over the flat panel of the lid forming a deep sump "u-shaped" to enclose a full body closure within a sump and an inverted "u-shaped".

10. A combination as in claim 9, the opening having a depressed channel raised over the flat panel of the lid forming a deep sump "u-shaped" to enclose a full body closure within a sump and a inverted "u-shaped" and a barrier rim with a thin breakable section as a tamper evident lid.

11. A combination as in claim 9, such as the inner wall of the depress cavity of the lid and the outer ring of the spout are being size relative to said outer diameter of the ring as to create a dose fit against the outer ring of the spout and the inner wall of the recess cavity of the lid.

* * * * *